US009607461B2

(12) United States Patent
Taylor

(10) Patent No.: US 9,607,461 B2
(45) Date of Patent: Mar. 28, 2017

(54) CURRENCY INSPECTION USING MOBILE DEVICE AND ATTACHMENTS

(71) Applicant: Arkeyo LLC, Doylestown, PA (US)

(72) Inventor: Daniel Taylor, Philadelphia, PA (US)

(73) Assignee: Arkeyo LLC, Doylestown, PA (US)

( * ) Notice: Subject to any disclaimer, the term of this patent is extended or adjusted under 35 U.S.C. 154(b) by 0 days.

(21) Appl. No.: 14/716,692

(22) Filed: May 19, 2015

(65) Prior Publication Data

US 2016/0063789 A1 Mar. 3, 2016

Related U.S. Application Data

(62) Division of application No. 14/210,175, filed on Mar. 13, 2014.

(51) Int. Cl.

| | |
|---|---|
| ***G07D 7/00*** | (2016.01) |
| ***G07D 5/00*** | (2006.01) |
| ***G07D 5/02*** | (2006.01) |
| ***G07D 5/08*** | (2006.01) |
| ***G07D 5/10*** | (2006.01) |

(52) U.S. Cl.

CPC ..... *G07D 5/00* (2013.01); *G07D 5/005* (2013.01); *G07D 5/02* (2013.01); *G07D 5/08* (2013.01); *G07D 5/10* (2013.01); *G07F 3/02* (2013.01); *G07F 3/025* (2013.01)

(58) Field of Classification Search

CPC ... G07F 7/04; G07F 19/20; G07F 7/00; G07F 7/12; G07F 7/20; G07F 11/0081; G07F 3/02; G07F 3/025; G07D 11/0084; G07D 5/00; G07D 5/005; G07D 5/02; G07D 5/08; G07D 5/10; B65H 2701/1912

USPC ..... 194/206, 207, 302, 327; 209/534; 382/135

See application file for complete search history.

(56) References Cited

U.S. PATENT DOCUMENTS

| | | | | |
|---|---|---|---|---|
| 3,939,953 | A * | 2/1976 | Miyazawa | G07D 5/00 194/317 |
| 5,542,880 | A * | 8/1996 | Geib | G07D 3/128 194/346 |
| 6,609,604 | B1 * | 8/2003 | Jones | G07D 3/06 194/302 |
| 2003/0155209 | A1 * | 8/2003 | Fujimoto | G07D 11/0006 194/205 |
| 2009/0148027 | A1 * | 6/2009 | Paraskevakos | G06K 9/38 382/135 |
| 2012/0169153 | A1 * | 7/2012 | Ueda | H02K 33/16 310/25 |

(Continued)

*Primary Examiner* — Jeffrey Shapiro
(74) *Attorney, Agent, or Firm* — Carr & Ferrell LLP

(57) ABSTRACT

Currency inspection using mobile devices and attachments are provided herein, as well as methods of use. In some embodiments, an apparatus may be configured to provide selections of currencies to a user via a display of the apparatus, obtain currency attributes for a selected currency, receive currency parameters for suspect currency using a currency evaluation device that is communicatively coupled with the apparatus, the currency evaluation device having a sensor array that comprises one or more sensors that are each configured to determine at least one currency parameter, compare the currency parameters for the suspect currency to the currency attributes, and output a warning message if the suspect currency is potentially counterfeit.

11 Claims, 5 Drawing Sheets

(56) References Cited

U.S. PATENT DOCUMENTS

2015/0356805 A1* 12/2015 Whiteman ..... G06K 7/0004
382/135

* cited by examiner

CURRENCY INSPECTION USING MOBILE DEVICE AND ATTACHMENTS

CROSS-REFERENCE TO RELATED APPLICATION

This application is a Divisional, and claims the priority benefit, of U.S. patent application Ser. No. 14/210,175 filed Mar. 13, 2014. The above referenced disclosure is hereby incorporated by reference in its entirety.

FIELD OF THE INVENTION

The present technology encompasses detection of counterfeit currency, and more specifically, but not by way of limitation, to devices and systems that are configured to detect counterfeit currency in a transactional setting such as a person-to-person transaction or merchant-to-customer transaction by leveraging attachments and/or mobile device features to inspect currency. Example currencies can include, but are not limited to physical (e.g., paper and coin) and virtual currencies.

SUMMARY

In some embodiments, the present technology is directed to an apparatus, comprising: (a) a mobile communications device having a processor and a memory for storing executable instructions that comprise a currency evaluation application; (b) a currency evaluation device that is communicatively coupled with the mobile communications device, the currency evaluation device being controlled by execution of the currency evaluation application by the processor of the mobile communications device, the currency evaluation device comprising: (c) a sensor array that comprises one or more sensors that are each configured to determine at least one currency parameter of suspect currency, the sensors outputting signals to the mobile communications device that are indicative of currency parameters detected by the one or more sensors; (d) the processor of the mobile communications device being configured to compare the currency parameters determined by the one or more sensors to currency attributes that are indicative of either authentic or counterfeit currency, and determine if the suspect currency is authentic or counterfeit.

In some embodiments, the present technology is directed to an apparatus, comprising: (a) a processor; (b) a memory for storing executable instructions, the processor executing the instructions to: (i) provide selections of currencies to a user via a display of the apparatus; (ii) obtain currency attributes for a selected currency; (iii) receive currency parameters for suspect currency using a currency evaluation device that is communicatively coupled with the apparatus, the currency evaluation device comprising a sensor array that comprises one or more sensors that are each configured to determine at least one currency parameter; (iv) compare the currency parameters for the suspect currency to the currency attributes; and (v) output a warning message if the suspect currency is potentially counterfeit.

In some embodiments, the present technology is directed to a method for evaluating authenticity of currency using a currency evaluation device coupled with a mobile communications device, the method comprising: (a) receiving, by the mobile communications device, a selection of a currency from a plurality of possible currencies; (b) obtaining currency attributes for the selected currency by the mobile communications device; (c) receive currency parameters for suspect currency from a currency evaluation device that is communicatively coupled with the mobile communications device, the currency evaluation device comprising a sensor array that comprises one or more sensors that are each configured to determine at least one currency parameter; (d) comparing, by the mobile communications device, the currency parameters for the suspect currency to the currency attributes; and (e) outputting, by the mobile communications device, a warning message if the suspect currency is potentially counterfeit.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DETAILED DESCRIPTION OF EXEMPLARY EMBODIMENTS

Figure 1:
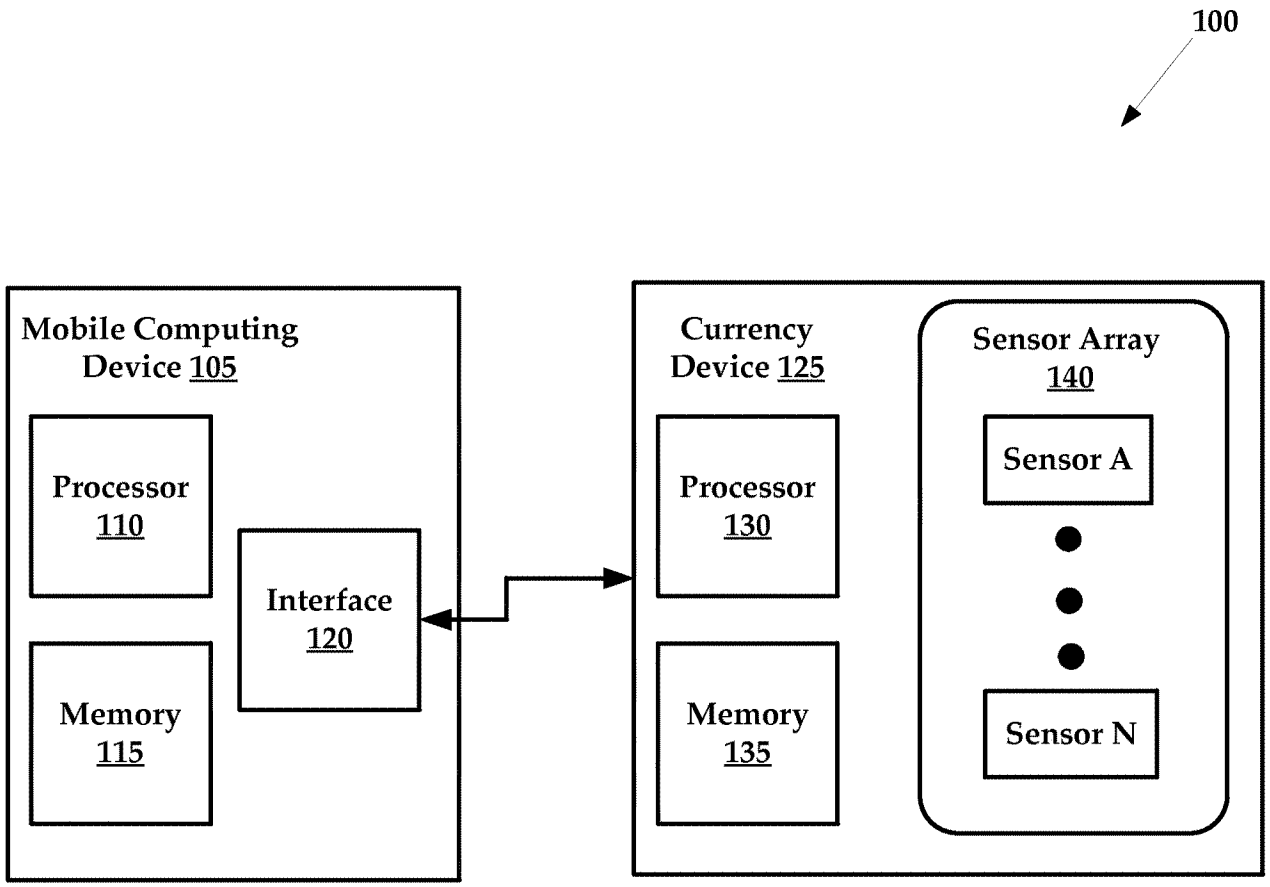
FIG. 1 is a schematic diagram of an exemplary system for practicing aspects of the present technology.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1") may be interchangeably used with its nonitalicized version (e.g., "N+1"). Such occasional interchangeable uses shall not be considered inconsistent with each other.

It is noted at the outset that the terms "coupled," "connected", "connecting," "electrically connected," etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity regardless of the type (analog or digital) of those signals. It is further noted that various figures (including component diagrams) shown and discussed herein are for illustrative purpose only, and are not drawn to scale.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Currently many governments around the world are experiencing a sharp increase in counterfeit bills and counterfeit high face value coins. While large counter top machines used by banks and armored services help to address the counterfeit problem, there are currently no working solutions that address counterfeit coins and bills for midsized retail customers and smaller businesses that accept cash.

By way of example, the British one-pound coin counterfeiting currently at a "level of political significance". Today within the UK 3.5% to 5% of all high value coins are counterfeit. The UK Royal Mint inspects a random sample of coins from across the country to establish the twice-yearly official rate. A spokesman said the Mint was working with organizations such as the Post Office, banks, the vending industry and law enforcement agencies to try to limit the supply of fake £1 coins in circulation. "We are concerned at the apparent upward trend," said the spokesman.

With fake £1 coins rising in circulation, figures show that nearly two million counterfeit £1 coins were returned to the Royal Mint in the last financial year (2013). This figure was more than 23 times higher than the number seized six years earlier. It is estimated that on average, £16,000 ($26,144 US) of high face value counterfeit coins are collected monthly per 20 coin machines in the London and Greater London region.

The British Treasury posted a number of documents onto their website in January 2010 in response to a "Freedom of Information" request by an unknown party. The documents consist of a thirty-page narrative group of minutes and memos from November 2008 to May 2009. Also posted were the last three of the Royal Mint's reports of their six-monthly surveys on the number of counterfeit one-pound coins found in circulation. The first narrative group document is the minutes of a meeting between HM Treasury and the Royal Mint, APAC (the group representing banks, cash centers etc.) and SOCA (the Serious Crime Agency) on the sixth November 2008. The meeting chairperson opened the meeting by stating that it was, "the first opportunity that all parties had met to discuss the issue". The meeting chairperson also advised that, "the issue of counterfeits had achieved" (a) "level of political significance and the Treasury Minister had been briefed accordingly."

As another example, the United States has accused the Democratic People's Republic of Korea (DPRK or North Korea) of counterfeiting U.S. $100 Federal Reserve notes ("Supernotes") and passing them off in various countries. Although North Korea denies complicity in any counterfeiting operation, at least $45 million in such Supernotes thought to be of North Korean origin have been detected in circulation, and estimates are that the country has earned from $15 to $25 million per year over several years from counterfeiting. The U.S. Secret Service estimates that North Korea has produced $45 million in Supernotes since 1989.

It has been confirmed that North Korea has passed off such bills in various countries and that the counterfeit bills circulate both within North Korea and around its border with China. Early versions of the counterfeit US bills lacked the bands of magnetic ink printed in distinctive patterns on different denominations of US money; later counterfeits rectify this error. Many $100 bills circulate in Asia where U.S. currency is often seen as a safer investment than local currency. This circulation results in and many seizures of Supernotes by Asian authorities.

Advantageously, the present technology provides devices and methods for detecting counterfeit currency in a transactional setting, rather than waiting for the currency to circulate undetected until the currency is processed at a bank or other institution that routinely screens their currency.

A portable counterfeit bill and coin detection system is necessary to enable those who handle cash and coins—namely retail and small businesses—a way to determine if the bills and coins they're accepting are genuine. Similarly, the invention will be used by vacationers to ensure the money they're receiving is not counterfeit. The present technology will utilize hardware coupled with smartphone technologies. The present technology will connect to the Internet updating its software thus keeping users as well as the invention software up-to-date as new counterfeit techniques emerge.

The present technology is embodied as various types of currency processing logic that can be stored in memory of a smartphone or in other suitable hardware devices. The logic can be executed by the processor of the smartphone coupled with the hardware device to enable the currency detection solutions that will be described herein. The present technology may utilize attachments, combinations of attachments, or combinations of attachments and capabilities resident within the smartphone and/or other hardware devices to perform counterfeit analysis on currency. The currency that can be tested with the present technology may include paper or bill form currency, as well as coin currency and other emerging currencies such as bitcoins and other similar currencies. In general, the present technology may detect the authenticity of any type of currency, assuming that the currency has attributes or properties that can be measured, examined, and/or compared to expected attributes or properties known to be associated with authentic currency. For example, a coin may be measured by examining density/weight, inspecting visual appearance, ring testing, and other similar methods associated with attributes. Paper currency may be measured by inspecting visual appearance, watermarking, holographic objects, magnetic strips, weight/mass, opacity, and other attributes. Virtual currencies, such as bitcoins, may be inspected by capturing images, such as QR codes, images, or other visual representations of the bitcoin. The QR codes can be evaluated to determine if any indicia of fraud or counterfeiting are present.

FIG. 1 is a schematic diagram of an exemplary system 100 for practicing aspects of the present technology. According to some embodiments, the system 100 may include a mobile computing device (hereinafter "device 105"), such as a cellular telephone, a laptop, a notebook, a tablet, or other similar computing device. The device 105 may comprise at least a processor 110 and a memory 115 for storing executable instructions (e.g., logic) that can determine the authenticity of currency, including both physical and virtual currency. Additional details regarding currency authentication functionalities of the present technology will be described in greater detail below.

The device 105 may also comprise one or more interfaces, such as interface 120 that allows the device 105 to communicatively couple with a currency evaluator device, such as currency device 125. The interface 120 may comprise any wired or wireless connection that would be known to one of ordinary skill in the art with the present disclosure before them. Examples of a wired connection would include firewire, USB, and Ethernet—just to name a few. Examples of wireless connections include, but are not limited to Bluetooth, Infrared, and Near Field Communications.

In some embodiments, such as when the device 105 is a cellular telephone, the currency device 125 may couple with the device 105 using an auxiliary port (e.g., interface) of the cellular telephone. Alternatively, the currency device 125 may interface with another communications port of the cellular telephone 105. In other embodiments, the currency device 125 is configured to communicatively and electrically couple with the device 105 using, for example, a headphone jack, such as commonly found on devices like cellular telephones, tablets, laptops, and so forth. Headphone jacks are a standard feature on most mobile devices and provide a more universal means of connection between the device 105 and the currency device 125.

In general, the logic of the device 105 may include a currency application that executes on the device 105. The currency application may include metrics or rules that are utilized to determine if currency evaluated by the currency device 125 is authentic or counterfeit. The currency application may provide various user interfaces (UI) that allow the user to interact with the program. For example, the user may be allowed to select a type of currency to evaluate, such as a specific coin or paper currency. By way of example, the user may select UK currency, and choose a coin currency type such as a £1. The application is pre-defined with criteria that are indicative of authentic £1 coins. The application may also be pre-defined with criteria that are indicative of counterfeit £1 coins. These criteria may be expressed as thresholds or ranges of expected values. For example, a weight of an authentic £1 coin may be pre-defined. Because counterfeit coins may be created that are substantially similar to the weight of the £1 coin, other criteria may be utilized such as visual appearance of markings on both sides of the coin. By comparing images taken of the coin to the expected markings of an authentic coin, the device 105 may authenticate the coin or flag it as being potentially counterfeit.

While the example above contemplates embodiments where an end user selects the currency that is being evaluated, it will be understood that a currency type can be automatically determined by the currency device 125 and device 105 after one or more types of currency examination have taken place. For example, the currency device 125 and device 105 may determine that a coin is a £1 coin after examining a weight and thickness of the coin, as well as after images of the coin have been compared to images of authentic £1 coins.

One of ordinary skill in the art will appreciate that the logic may include attributes or criteria for a wide variety of physical and virtual currencies. Correspondingly, the currency device 125 and device 105 may cooperate to detect a wide variety of attributes of a suspect piece of currency, and compare the actual attributes of the suspect currency to expected attributes for an authentic version of that suspect currency.

The currency device 125 may comprise a processor 130 and memory 135 that stores executable instructions for controlling various sensors and/or measurement related components of the currency device 125 that can be used to detect a wide variety of measurable physical attributes of physical currency such as coins and paper currency. The sensors and/or measurement related components are illustrated as a sensor array 140 that may include one or more devices such as sensor A through sensor N. The sensor array 140 may include a single sensor, or a combination of various sensors and/or measurement devices.

For example, a sensor may include a density, mass, or weight measurement device (such as a laser) that can measure coin currency density, mass, or weight which may indicate if the coin is counterfeit. In another example a sensor may include a camera that examines the coin for casting marks or seams that are indicative of counterfeiting. The camera may obtain images of the coin and compare the images to known counterfeits and/or known authentic currency and determine a correspondence therebetween. If the coin has one or more indicia of counterfeiting, the currency device 125 may output a signal to the device 105 that the coin is potentially counterfeit.

In some instances, one or more sensors may measure thickness, edge pattern (e.g., ridges), conductivity, magnetism, metallic content or composition, obverse and reverse patterns, and combinations thereof.

The currency device 125 may include a slot or groove into which the coin is inserted. An exemplary sensor may measure thickness or other dimensions of the coin when the coin is inserted into the slot. Another sensor may sense magnetic forces and/or electrical conductivity. Another sensor may detect reflectivity, while another sensor may be configured to detect sound waves produced by the coin being vibrated against a plate or other device.

In some instances integrated features of the device 105 may be utilized in conjunction with one or more sensors of the currency device 125. For example, a coin may be placed onto the currency device 125, which is in physical contact with the device 105. Vibrations generated by the device 105 may transfer to the currency device 125 and cause the coin to vibrate. A sensor in the currency device 125 may detect and measure the sound of the coin, which may be indicative of the authenticity of the coin. By way of example, a silver coin will produce a noticeably different sound when vibrated compared with lead, steel, or other material used to create a counterfeit coin.

By way of another example, the currency device 125 may include a thickness measurement device, such as an optical measuring device that determines the thickness of the subject coin. The currency device 125 may also measure the magnetism of the coin with a magnet or other sensor that can detect magnetic fields. Further, the device 105 may utilize an integrated camera, residing within the device 105 to capture images of each surface of the coin.

As mentioned above, the processor 110 of the device 105 may execute logic stored in memory 115 to analyze the output of the currency device 125, which includes output from the various sensors in the currency device 125. In some embodiments, the device 105 may compare expected values to empirical output of the sensors to determine if the coin is authentic or counterfeit as described above.

In another example, the currency device 125 may evaluate a US $100 bill. The currency device 125 may use a sensor to detect a magnetic strip in the suspect currency, as well as images of the currency to detect fibers, color variations, and other visual indicators of authenticity. The device 105 may utilize these various empirical attributes detected by the currency device 125 by comparing them to expected attributes of an authentic $100 bill. If one or more of the attributes are discrepant, the application may generate a UI that includes a warning message that the currency may be counterfeit. Alternatively, the application may output a warning sound or a combination of a sound and a visual warning.

In general, the currency device 125 may operate in a standalone manner, using internal power and being self-contained in processing capabilities. In other instances, the currency device 125 may utilize power/or other computing resources of the device 105 as needed. Also, in some instances, the device 105 may couple with more than one currency device. That is, multiple currency devices may be coupled with the device 105 to accomplish various types of measurements. For example, one currency device may be configured to detect magnetism and electrical conductivity, and a second currency device may detect the size, shape, and weight of currency. The device 105 may utilize output from multiple currency devices to determine the authenticity of a suspect piece of currency.

In some instances the currency application is controlled by logic included in the device 105 rather than the currency device 125 requiring a dedicated processor and/or memory.

Figure 2:
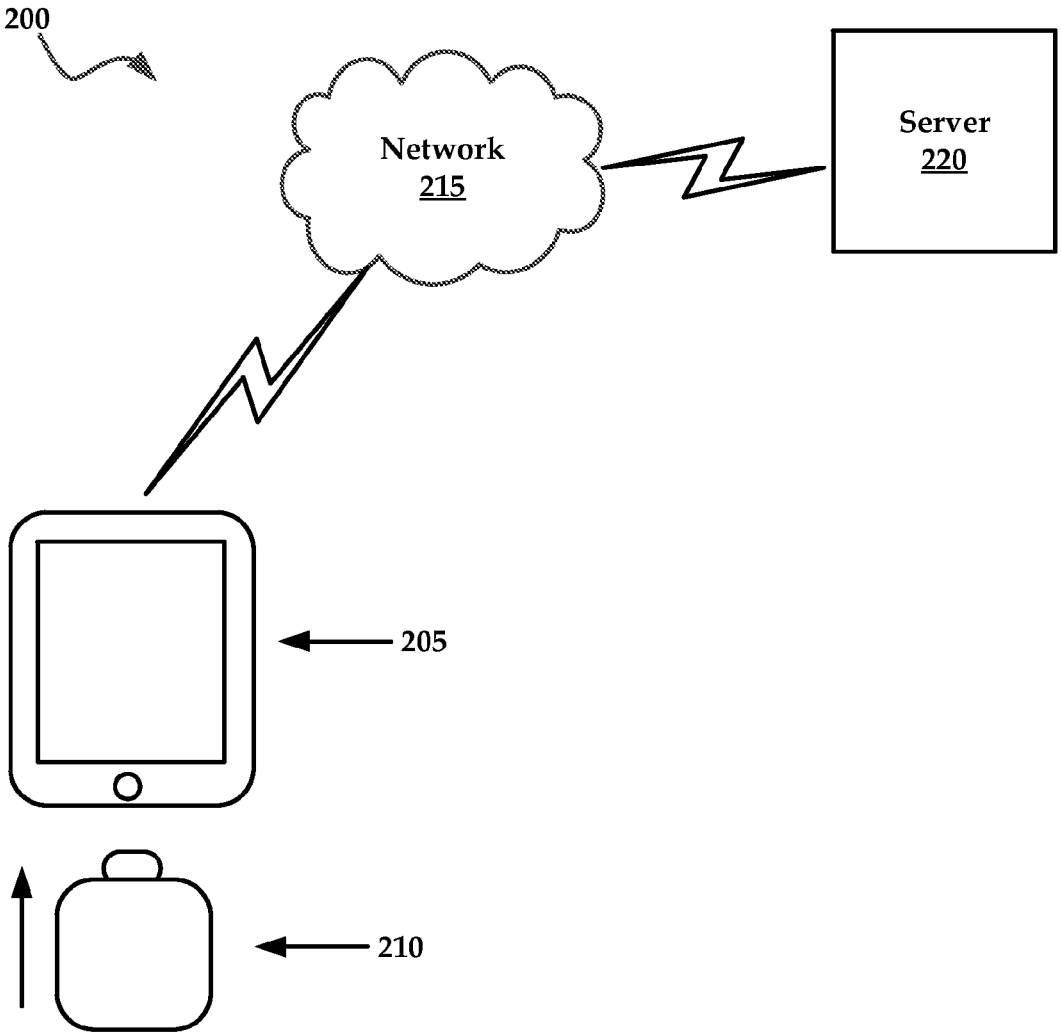
FIG. 2 is a schematic diagram of another exemplary system for practicing aspects of the present technology.

FIG. 2 is a schematic diagram of another exemplary system 200 that may be used to practice aspects of the present technology. The system 200 includes a mobile device such as a tablet 205, which is similar in configuration and operation to the device 105 of FIG. 1. A currency device 210 is coupled directly to the tablet 205 and may be communicatively coupled to the tablet 205 via a wire or wireless connection. The currency device 210 may be constructed similarly to the currency device 125 of FIG. 1.

The system 200 also includes a server 220 that communicates with the tablet 205 via a network 215 that may include any private or public network such as a cellular telephone network or the Internet. Suitable networks may include or interface with any one or more of, for instance, a local intranet, a PAN (Personal Area Network), a LAN (Local Area Network), a WAN (Wide Area Network), a MAN (Metropolitan Area Network), a virtual private network (VPN), a storage area network (SAN), a frame relay connection, an Advanced Intelligent Network (AIN) connection, a synchronous optical network (SONET) connection, a digital T1, T3, E1 or E3 line, Digital Data Service (DDS) connection, DSL (Digital Subscriber Line) connection, an Ethernet connection, an ISDN (Integrated Services Digital Network) line, a dial-up port such as a V.90, V.34 or V.34 bis analog modem connection, a cable modem, an ATM (Asynchronous Transfer Mode) connection, or an FDDI (Fiber Distributed Data Interface) or CDDI (Copper Distributed Data Interface) connection. Furthermore, communications may also include links to any of a variety of wireless networks, including WAP (Wireless Application Protocol), GPRS (General Packet Radio Service), GSM (Global System for Mobile Communication), CDMA (Code Division Multiple Access) or TDMA (Time Division Multiple Access), cellular phone networks, GPS (Global Positioning System), CDPD (cellular digital packet data), RIM (Research in Motion, Limited) duplex paging network, Bluetooth radio, or an IEEE 802.11-based radio frequency network. The network 215 can further include or interface with any one or more of an RS-232 serial connection, an IEEE-1394 (Firewire) connection, a Fiber Channel connection, an IrDA (infrared) port, a SCSI (Small Computer Systems Interface) connection, a USB (Universal Serial Bus) connection or other wired or wireless, digital or analog interface or connection, mesh or Digi® networking.

Rather than requiring the tablet 205 to store criteria that is used to determine the authenticity of currency measured by the currency device 210, the server 220 may be configured to store the pre-defined currency criteria described above. Further, the server 220 may also receive empirical currency measurement data from the currency device 210, via communications with the tablet 205. Also, the server 220 may be configured to perform various comparative currency analyses in order to detect counterfeit currency.

The tablet 205 may execute a more limited UI based application that allows the user to interact with the currency analysis features of the server 220 on a mobile platform. In some embodiments the tablet 205 may be populated with pre-defined currency data as needed, such as when the currency device 210 is in use. The tablet 205 may obtain only the data necessary to evaluate the currency that is being examined using the currency device 210.

Figure 3:
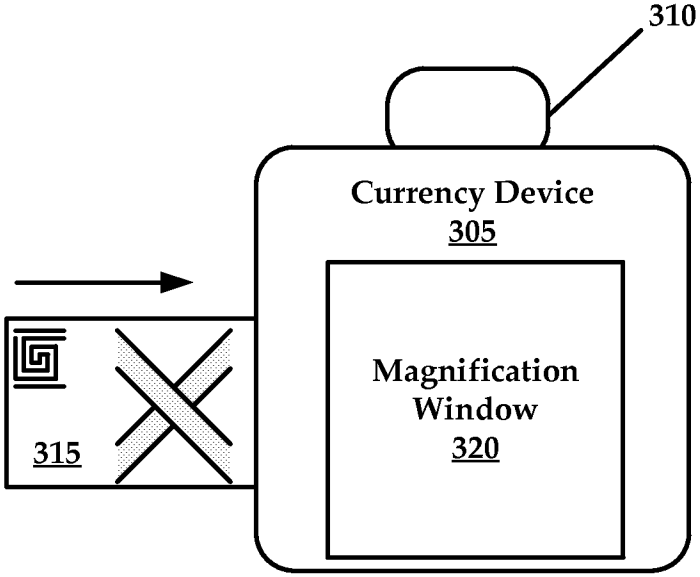
FIG. 3 is a front elevational view of an exemplary currency device used to analyze paper currency.

FIG. 3 is an exemplary currency device 305 that includes a housing that is configured to house the electronics of an exemplary currency device as described above with respect to FIG. 1. The currency device 305 may comprise a physical interface 310 that allows the currency device 305 to plug into a mobile device, such as the tablet 205 of FIG. 2. The currency device 305 may scan or otherwise evaluate various forms of paper currency, such as paper currency 315, which may include a Supernote or other similar currency. The housing is of the currency device 305 is configured to receive the paper currency and scan the paper currency for attributes that are indicative of counterfeiting or authenticity. For example, the currency device 305 may include sensors such as a metal detector, which senses magnetic strips, a bar code reader, a QR code reader, or other similar sensors.

In some instances, the currency device 305 may comprise a magnification window 320 that allows a user to visually inspect the currency as it passes through the currency device 305. The currency device 305 may comprise backlighting, blue lighting, or other similar features that aid the user in identifying features that are present in the currency such as fibers, opacity of the paper, watermarks, and so forth. The magnification window 320 may also be configured to display images of either authentic or counterfeit currency to the user such that the user can compare the currency and the images to one another. In one example, an image of an authentic piece of currency may be overlaid on the currency that can be seen through the magnification window 320. The user can set the transparency of the image that is displayed on the magnification window 320, or may modify other attributes such as image reversing, contrast, color, or other attributes. The various selectable features and operational characteristics of the currency device 305 may be controlled via a currency application that executes on the mobile device. For example, the currency application may generate UIs that allow the user to control the operation and functions of the currency device 305 such as sensor function, backlighting, image capturing and/or display/overlay. The magnification window may include a touchscreen display.

According to some embodiments, the currency device 305 may operate in a standalone manner to provide the described functionalities without need of a mobile device. Alternatively, the currency device 305 may require connection with a mobile device to facilitate operation of the currency device 305. For example, the currency device 305 may utilize the processor of the mobile device to implement the functions described above. The functions provided by the currency device may be controlled by a currency application that is stored in memory of the mobile device and is executed on the mobile device. The data obtained by the sensors of the currency device 305 may be output to the mobile device using the physical interface, although as mentioned above, the currency device may have a wireless interface as opposed to a wired interface.

Figure 4:
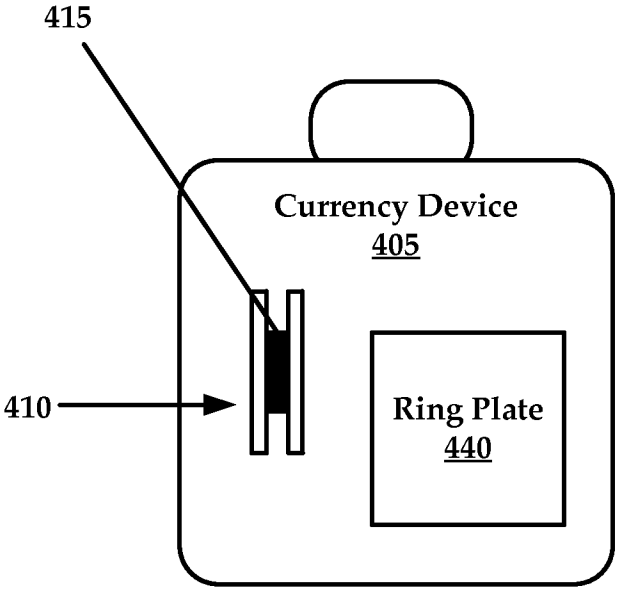
FIG. 4 is a front elevational view of an exemplary currency device used to analyze coin currency.

FIG. 4 is another currency device 405 that is configured to evaluate coin currency, such as coin 415. The currency device 405 is constructed similarly to the currency device 125 of FIG. 1, but specifically includes a coin analysis device 410 that is configured to allow a coin slide therethrough and to detect various attributes of the coin. For example, the coin analysis device 410 may measure the thickness of the coin, or may detect a ridge pattern on the side of the coin. In another embodiment, the coin analysis device 410 may detect magnetic content (or lack thereof) in a coin and may also detect casting marks or other indicia of counterfeiting.

In some instances, the currency device 405 may also include a ring plate 440. Coins may be vibrated on the ring plate 440 and sounds generated by this vibration may be captured by audio sensors on the currency device 405 or an associated mobile device. The ring plate 440 may use interchangeable plates that are used to examine various types of coins. For example, a silver coin may require a different plate relative to a gold coin.

It will be understood that while currency device 305 and currency device 405 have been described as two separate devices, one of ordinary skill in the art will appreciate that the coin analysis device 410 and ring plate 440 of currency device 405 may be combined onto the back surface of currency device 305.

Figure 5:
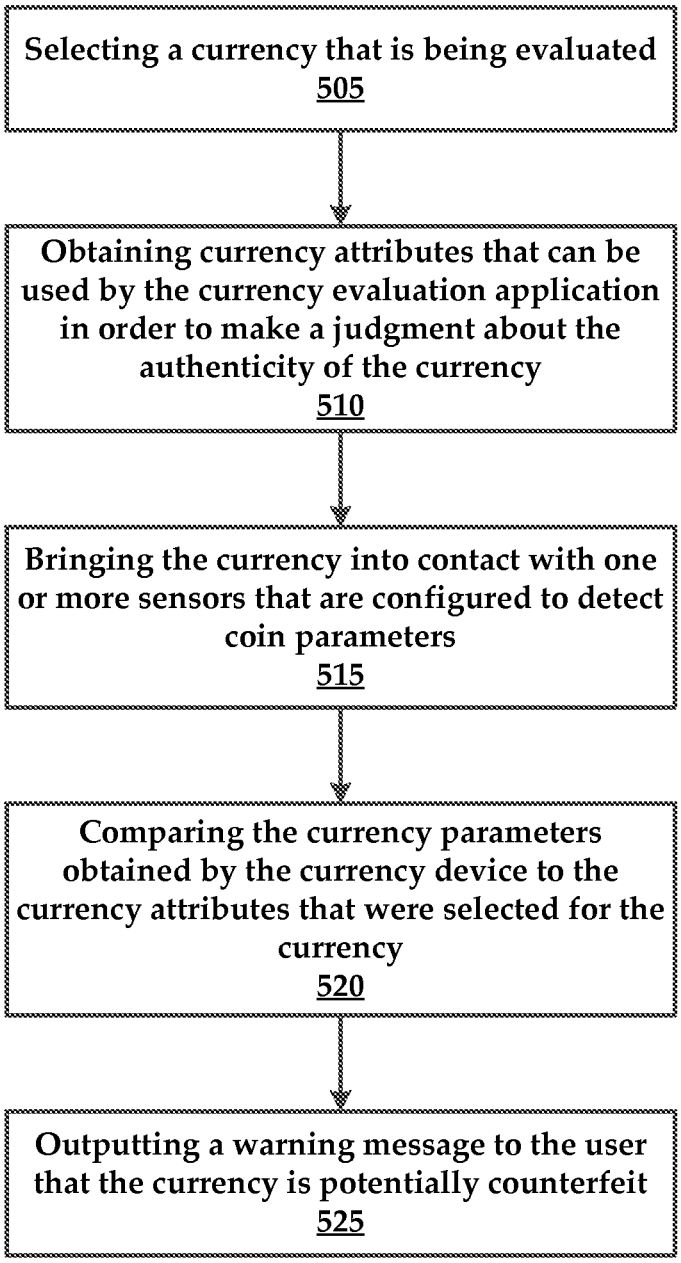
FIG. 5 is a flowchart of an exemplary method for evaluating the authenticity of currency.

FIG. 5 is flowchart of an exemplary method that is executed by a mobile device in combination with a currency device that is configured to evaluate suspect physical and virtual currency to determine the authenticity of the currency, specifically to detect counterfeit currency. The method may be executed by a currency device alone, or in combination with the mobile device. In one example, the mobile device may execute a currency application that controls operations of a currency device that is attached to the mobile device. The processor of the mobile device may execute currency evaluation logic that is stored in memory of the mobile device to control the operations and functions of the currency device, as well as provide UIs that allow end users to interact with the currency device.

In some instances, the method includes selecting 505 a currency that is being evaluated. For example, the user may desire to determine the authenticity of a coin. The user may select the desired currency as an option from a UI generated by the currency evaluation application. Once selected, the method may include obtaining 510 currency attributes that can be used by the currency evaluation application in order to make a judgment about the authenticity of the coin. For example, the currency attributes may include weight, diameter, thickness, ring tone, and magnetic content or conductivity. Each of these attributes may be associated with a threshold or expected value. For example, the weight may be 9.5 grams and the thickness may be 22.5 millimeters. In some instances, attributes may be acceptable ranges of values, rather than single values.

These currency attributes may be stored in the mobile device or may be loaded onto the mobile device from a server. For example, when the mobile device determines that the currency selection is for a particular coin, the mobile device, and specifically the currency evaluation application, may request currency attributes from the server, rather than requiring the mobile device to store currency attributes for a wide variety of coins and paper currency. Furthermore, virtual currency attributes may also be obtained in the event that the currency device is attempting to authenticate a virtual currency such as a bitcoin.

The method may include bringing 515 the currency into contact with one or more sensors that are configured to detect coin parameters that correspond to the currency attributes selected above. For example, the coin may be passed through a slot that is configured with sensors that detect any of weight, diameter, thickness, ring tone (e.g., a sound made by the coin when struck or vibrated), and magnetic content or conductivity. Examples of sensors are described in the foregoing portions of the disclosure. It is noteworthy that the one or more sensors are associated with a currency device(s) that couple with a mobile device. Thus, users can evaluate currency in a transactional setting, rather than having to rely entirely on manual inspection or waiting for the currency to be identified as counterfeit by a bank or other organization. In this way, counterfeit currency can be easily identified and removed from circulation.

The method may include comparing 520 the currency parameters obtained by the currency device to the currency attributes that were selected for the currency. If a discrepancy is detected, the method may include outputting 525 a warning message to the user that the currency is potentially counterfeit. Alternatively, if the comparison does not indicate that the coin is counterfeit, the method may include outputting a message that the currency is authentic.

Figure 6:
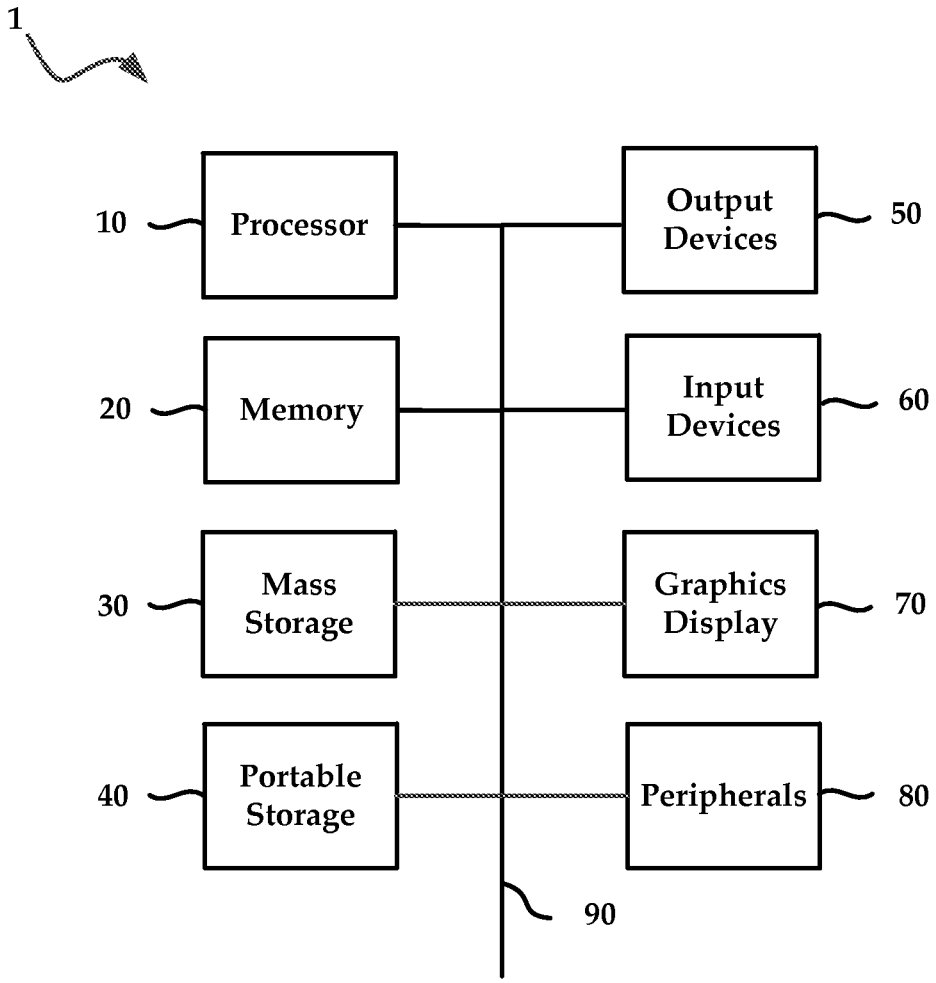
FIG. 6 illustrates an exemplary computing system that may be used to implement embodiments according to the present technology.

FIG. 6 illustrates an exemplary computing device 1 that may be used to implement an embodiment of the present systems and methods. The system 1 of FIG. 6 may be implemented in the contexts of the likes of clients, information display systems, computing devices, terminals, networks, servers, or combinations thereof. The computing device 1 of FIG. 6 includes a processor 10 and main memory 20. Main memory 20 stores, in part, instructions and data for execution by processor 10. Main memory 20 may store the executable code when in operation. The system 1 of FIG. 6 further includes a mass storage device 30, portable storage device 40, output devices 50, user input devices 60, a graphics display system 70, and peripherals 80.

The components shown in FIG. 6 are depicted as being connected via a single bus 90. The components may be connected through one or more data transport means. Processor 10 and main memory 20 may be connected via a local microprocessor bus, and the mass storage device 30, peripherals 80, portable storage device 40, and display system 70 may be connected via one or more input/output (I/O) buses.

Mass storage device 30, which may be implemented with a magnetic disk drive or an optical disk drive, is a non-volatile storage device for storing data and instructions for use by processor 10. Mass storage device 30 can store the system software for implementing embodiments of the present technology for purposes of loading that software into main memory 20.

Portable storage device 40 operates in conjunction with a portable non-volatile storage medium, such as a floppy disk, compact disk or digital video disc, to input and output data and code to and from the computing system 1 of FIG. 6. The system software for implementing embodiments of the present technology may be stored on such a portable medium and input to the computing system 1 via the portable storage device 40.

Input devices 60 provide a portion of a user interface. Input devices 60 may include an alphanumeric keypad, such as a keyboard, for inputting alphanumeric and other information, or a pointing device, such as a mouse, a trackball, stylus, or cursor direction keys. Additionally, the system 1 as shown in FIG. 6 includes output devices 50. Suitable output devices include speakers, printers, network interfaces, and monitors.

Graphics display system 70 may include a liquid crystal display (LCD) or other suitable display device. Graphics display system 70 receives textual and graphical information, and processes the information for output to the display device. Peripherals 80 may include any type of computer support device to add additional functionality to the computing system. Peripherals 80 may include a modem or a router.

The components contained in the computing system 1 of FIG. 6 are those typically found in computing systems that may be suitable for use with embodiments of the present technology and are intended to represent a broad category of such computer components that are well known in the art. Thus, the computing system 1 can be a personal computer, hand held computing system, telephone, mobile computing system, workstation, server, minicomputer, mainframe computer, or any other computing system. The computer can also include different bus configurations, networked platforms, multi-processor platforms, etc. Various operating systems can be used including UNIX, Linux, Windows, Macintosh OS, Palm OS, and other suitable operating systems.

Some of the above-described functions may be composed of instructions that are stored on storage media (e.g., computer-readable medium). The instructions may be retrieved and executed by the processor. Some examples of storage media are memory devices, tapes, disks, and the like. The instructions are operational when executed by the processor to direct the processor to operate in accord with the technology. Those skilled in the art are familiar with instructions, processor(s), and storage media.

It is noteworthy that any hardware platform suitable for performing the processing described herein is suitable for use with the technology. The terms "computer-readable storage medium" and "computer-readable storage media" as used herein refer to any medium or media that participate in providing instructions to a CPU for execution. Such media can take many forms, including, but not limited to, non-volatile media, volatile media and transmission media. Non-volatile media include, for example, optical or magnetic disks, such as a fixed disk. Volatile media include dynamic memory, such as system RAM. Transmission media include coaxial cables, copper wire and fiber optics, among others, including the wires that comprise one embodiment of a bus. Transmission media can also take the form of acoustic or light waves, such as those generated during radio frequency (RF) and infrared (IR) data communications. Common forms of computer-readable media include, for example, a floppy disk, a flexible disk, a hard disk, magnetic tape, any other magnetic medium, a CD-ROM disk, digital video disk (DVD), any other optical medium, any other physical medium with patterns of marks or holes, a RAM, a PROM, an EPROM, an EEPROM, a FLASHEPROM, any other memory chip or data exchange adapter, a carrier wave, or any other medium from which a computer can read.

Various forms of computer-readable media may be involved in carrying one or more sequences of one or more instructions to a CPU for execution. A bus carries the data to system RAM, from which a CPU retrieves and executes the instructions. The instructions received by system RAM can optionally be stored on a fixed disk either before or after execution by a CPU.

Computer program code for carrying out operations for aspects of the present technology may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the invention in the form disclosed. Many modifications and variations will be apparent to those of ordinary skill in the art without departing from the scope and spirit of the invention. Exemplary embodiments were chosen and described in order to best explain the principles of the present technology and its practical application, and to enable others of ordinary skill in the art to understand the invention for various embodiments with various modifications as are suited to the particular use contemplated.

Aspects of the present technology are described above with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present technology. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. An apparatus, comprising:

a handheld computing device having a processor and a memory for storing executable instructions that comprise a coin evaluation application; and a portable coin evaluation device that is communicatively coupled with the handheld computing device, the coin evaluation device being controlled by execution of the coin evaluation application by the processor of the handheld computing device, the coin evaluation device comprising:

a sensor array that comprises one or more sensors that are each configured to determine at least one of multiple coin parameters of a coin being evaluated, the sensors outputting signals to the handheld computing device that are indicative of coin parameters detected by the one or more sensors;

the processor of the handheld computing device being configured to compare the coin parameters determined by the one or more sensors to coin attributes that are indicative of authentic coins, and determine if the coin being evaluated is authentic or counterfeit; and a selected one ring plate chosen from a plurality of interchangeable ring plates that is configured to vibrate the coin being evaluated when the coin is placed on the ring plate, wherein at least one of the one or more sensors is an audio sensor that captures sound generated by the vibration of the coin being evaluated, wherein the processor of the handheld computing device compares a sound profile of the coin being evaluated obtained by the audio sensor to a sound profile of an authentic coin.

2. The apparatus according to claim 1, wherein the one or more sensors comprise a coin slot that is configured to receive and measure coin parameters of coins.

3. The apparatus according to claim 2, wherein the coin slot measures any of thickness, diameter, edge pattern, obverse and reverse patterns, and combinations thereof.

4. The apparatus according to claim 2, wherein the coin slot measures any of conductivity, magnetism, reflectivity, metallic content and composition, and combinations thereof.

5. The apparatus according to claim 2, wherein the coin slot measures any of density, mass, weight, and combinations thereof.

6. The apparatus according to claim 2, wherein the coin slot comprises at least one of a laser measuring device and an optical measuring device.

7. The apparatus according to claim 1, wherein the one or more sensors comprise a camera to capture an image of casting marks or seams of the coin.

8. The apparatus according to claim 1, wherein the handheld computing device receives the coin attributes that are indicative of authentic coins from a server upon request.

9. The apparatus according to claim 1, wherein the processor is further configured to output a warning signal if the coin being evaluated is counterfeit, or output a pass signal if the coin being evaluated is authentic.

10. The apparatus according to claim 1, wherein the interchangeable ring plates evaluate various types of coins.

11. A method for evaluating authenticity of coins using a coin evaluation device coupled with a handheld computing device, the method comprising:

receiving, by the handheld computing device, a selection of a coin from a plurality of possible coins;

obtaining a plurality of coin attributes for the selected coin by the handheld computing device, wherein at least one coin attribute is a coin sound profile;

receiving coin parameters for a suspect coin from a coin evaluation device that is communicatively coupled with the handheld computing device, the coin evaluation device comprising a selected one ring plate chosen from a plurality of interchangeable ring plates that is configured to vibrate the suspect coin when the suspect coin is placed on the ring plate and a sensor array that comprises one or more sensors that are each configured to determine at least one coin parameter, wherein at least one of the one or more sensors is an audio sensor that captures sound generated by the vibration of the suspect coin;

comparing, by the handheld computing device, the coin parameters for the suspect coin to the coin attributes; and outputting, by the handheld computing device, a warning message if the suspect coin is potentially counterfeit.

* * * * *